United States Patent [19]

Cox

[11] Patent Number: 5,071,385

[45] Date of Patent: Dec. 10, 1991

[54] POSABLE FIGURE

[76] Inventor: Colleen L. Cox, 836 M #105, Anchorage, Ak. 99501

[21] Appl. No.: 455,753

[22] Filed: Mar. 13, 1990

[51] Int. Cl.[5] ..... A63H 3/02

[52] U.S. Cl. ..... 446/129; 446/369; 446/139

[58] Field of Search ..... 446/129, 139, 137, 369, 446/390, 134

[56] References Cited

U.S. PATENT DOCUMENTS

| | | | |
|---|---|---|---|
| 1,336,898 | 4/1920 | Flynn | 446/369 |
| 1,551,050 | 8/1925 | Parsons | 446/139 |
| 3,789,547 | 2/1974 | Chemarin | 446/901 X |

FOREIGN PATENT DOCUMENTS

| | | | |
|---|---|---|---|
| 196865 | 5/1923 | United Kingdom | 446/139 |
| 544661 | 4/1942 | United Kingdom | 446/139 |

*Primary Examiner*—Mickey Yu

*Attorney, Agent, or Firm*—Christensen, O'Connor, Johnson & Kindness

[57] ABSTRACT

A posable Figure (10) including a stuffing (14) that forms the Figure's head (16), torso (18) and limbs (20, 22), covered by a Fabric (12). Magnets (24) mounted under the fabric within the Figure's limbs are joinable with opposing magnets (28) mounted under the Fabric within the Figure's head to pose the Figure.

6 Claims, 2 Drawing Sheets

POSABLE FIGURE

FIELD OF THE INVENTION

The present invention relates to figures resembling human and animal forms, and particularly to toy figures with posable limbs.

BACKGROUND OF THE INVENTION

Figures resembling humans and animals, such as dolls, bears, and other figures, have long been popular toys for the entertainment of children. Children enjoy posing these figures in configurations mimicking the child's activities, such as playing "peek-a-boo" games and praying. Accordingly, it is desirable for a child's entertainment and education to have a toy figure with posable limbs that may be positioned with respect to the figure's torso and head, and retained in that position.

SUMMARY OF THE INVENTION

The present invention provides a fabric-covered figure having limbs and a head attached to a torso, and further including an attractive device disposed underneath the fabric covering of at least one limb that is joinable with an opposing attractive device disposed underneath the fabric at another point in the figure.

In a preferred embodiment of the present invention, the first attractive device comprises a magnet disposed beneath the fabric covering of at least one limb, and the opposing attractive device comprises an opposing magnet disposed beneath the fabric within the figure's torso or head.

A figure constructed in accordance with the present invention may thus be posed by moving the figure's limb to join the attractive device in the limb with the opposing attractive device in the torso or head. The joined opposing magnets retain the figure in this position. By virtue of the disposition of the magnets underneath the fabric covering the figure, the magnets may not be removed from the figure by a child and thus do not present a safety hazard to the child. Further, the provision of opposing magnets underneath the fabric provides the figure with a smooth, uniform external surface that is more appealing to the child.

BRIEF DESCRIPTION OF THE DRAWINGS

The present invention will be readily understood by those of ordinary skill in the art upon reading the following specification in conjunction with the appended drawings in which.

DETAILED DESCRIPTION OF THE PREFERRED EMBODIMENT

Figure 2:
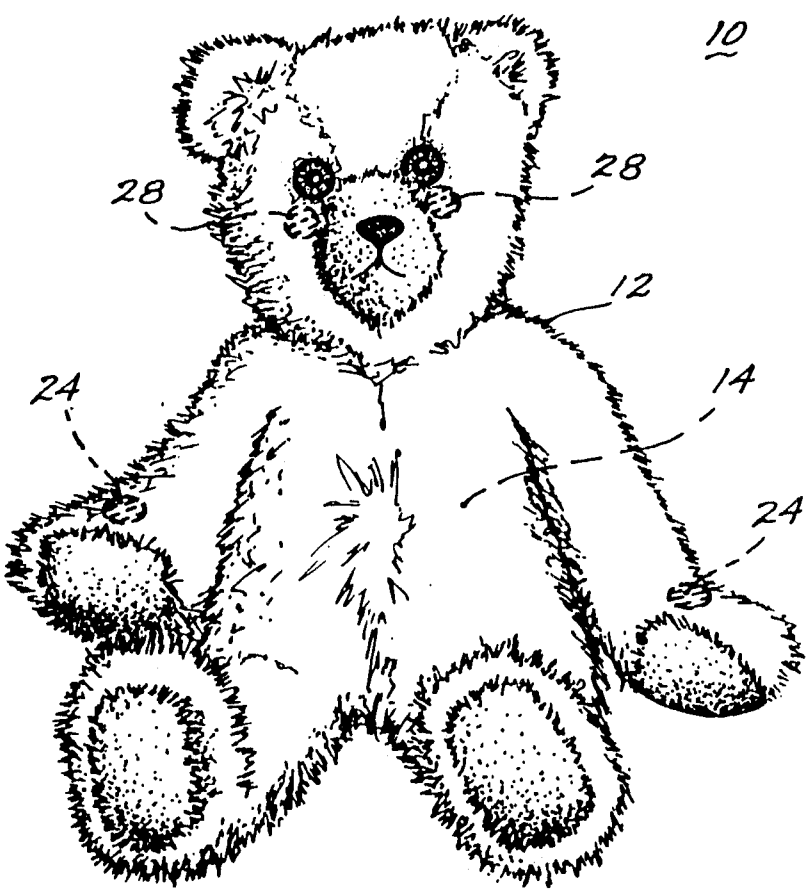
FIG. 2 shows a front elevation view of the preferred embodiment of FIG. 1, with the magnets in the forward paws positioned away from the magnets located in proximity to the eyes.
Figure 1:
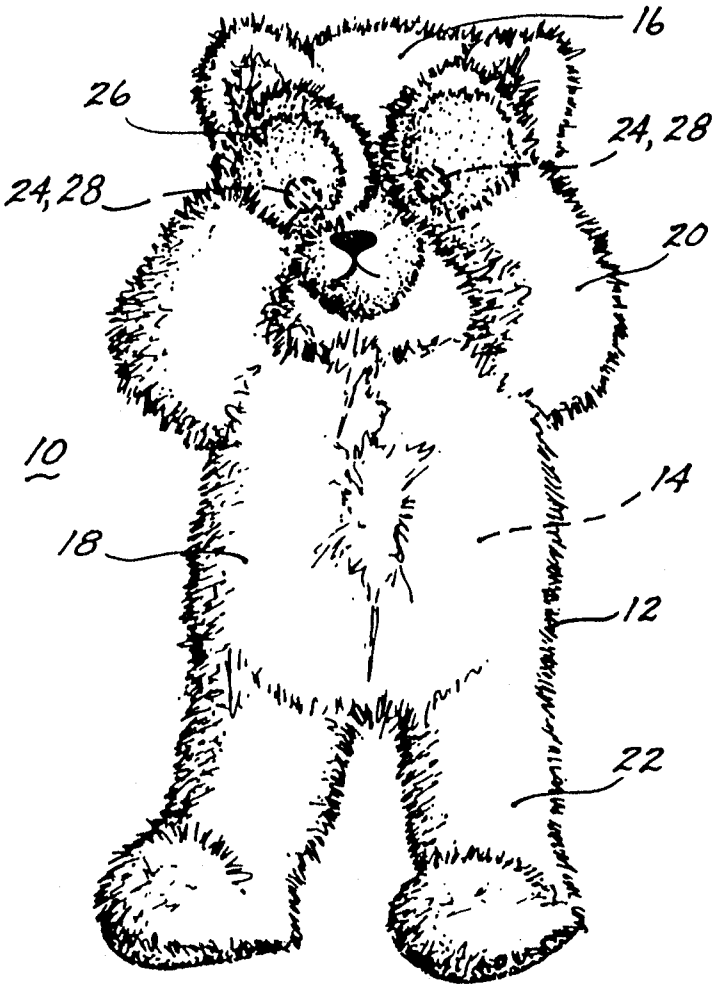
FIG. 1 shows a front elevation view of a preferred embodiment of the present invention in the form of a posable bear having its forward paws positioned to cover its eyes.

A preferred embodiment of a posable FIG. 10 constructed in accordance with the present invention is illustrated in FIGS. 1 and 2. In the preferred embodiment illustrated, the posable FIG. 10 is configured as a bear. However, it should be apparent that posable figures constructed in accordance with the present invention may take various other forms, such as other animal figures, or dolls resembling humans. The FIG. 10 includes a fabric 12 that covers an inner stuffing 14. In the preferred embodiment, the fabric 12 is a plush fur fabric that extends to cover the figure's head 16, torso 18 and limbs, including two arms 20 and legs 22. As illustrated in FIG. 1, the FIG. 10 may include contrasting patches of non-plush material at points such as the figure's snout and paws. The FIG. 10 may also include a lining (not shown) between the fabric 12 and the stuffing 14.

The FIG. 10 includes at least a first attractive device and an opposing attractive device disposed underneath the figure's fabric 12 to enable posing of the figure. In the preferred embodiment illustrated in FIGS. 1 and 2, the first attractive device and opposing attractive device comprise magnets. A first magnet 24 is inserted underneath the fabric 12 covering each forward paw 26 of the figure's arms 20. Opposing magnets 28 are inserted underneath the fabric 12 within the nose and eye area of the figure's head 16, in proximity to each of the figure's eyes. The magnets 24 and 28 are disposed between the fabric 12 and the underlying stuffing 14.

Referring to FIG. 1, the figure's arms 20 may be posed by joining each first magnet 24 with an opposing magnet 28 in the figure's head. In this position, the figure appears to be covering its eyes to enable a child to play a "peek-a-boo" game. The arms 20 remain in this position until the child removes the arms by pulling the paws 26 to break the attraction between the first magnets 24 and the opposing magnets 28. The arms then return to their relaxed position, as shown in FIG. 2.

Figure 3:
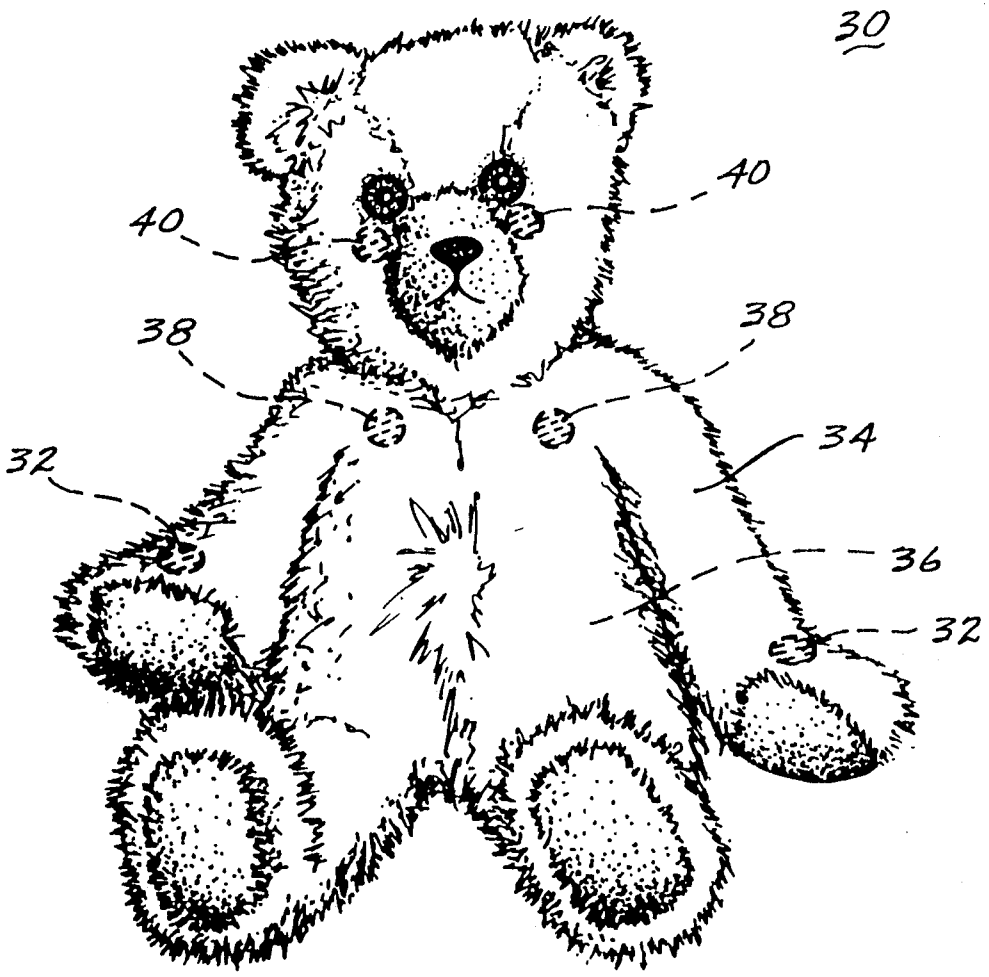
FIG. 3 shows a front elevation view of an alternate embodiment of the present invention including magnets underneath the fur of the bear's forward paws and opposing magnets underneath the fur in proximity to the bear's eyes and within the bears's torso.

While the preferred embodiment of a FIG. 10 has been illustrated as including first magnets disposed within the figure's arms and opposing magnets disposed within the figure's head, it should be apparent that other configurations of first magnets and opposing magnets may be utilized in accordance with the present invention. For example, FIG. 3 provides an alternate embodiment of a posable FIG. 30 having first magnets 32 disposed underneath an exterior fabric 34, between the fabric 34 and a stuffing 36, within the figure's forward paws. The FIG. 30 further includes a pair of first opposing magnets 32 and a pair of second opposing magnets 38 disposed underneath the fabric covering the chest area of the figure's torso. A second pair of opposing magnets 40 is disposed underneath the fabric covering the figure's nose and eye area. This configuration of a posable FIG. 30 allows the figure's arms to be positioned to cover the figure's chest by joining the first magnets 32 and the first opposing magnets 38, to mimic a "praying" posture. Alternatively, the first magnets 32 can be mated with the second opposing magnets 40 in the figure's head to play a "peek-a-boo" game.

One of ordinary skill, after reading the foregoing specification, will be able to effect various other changes, alterations, and substitutions of equivalents without departing from the broad concepts disclosed. For example, combinations of first magnets and opposing magnets other than those described above can be incorporated into a posable figure constructed in accordance with the present invention. It is therefore intended that the scope of Letters Patent granted hereon be limited only by the definition contained in the appended claims and the equivalents thereof.

I claim:

1. A posable figure comprising:

a formative support defining a head, a torso, and a plurality of limbs;

a fabric disposed on the exterior of the formative support;

a first magnet disposed under the fabric within a first limb; and an opposing magnet disposed under the fabric within at least one of the figure's head, and torso, to enable posing of the first limb by joining the first magnet with the opposing magnet.

2. The posable figure of claim 1, wherein the formative support comprises a stuffing, the first magnet and the opposing magnet each being disposed between the stuffing and an overlying portion of the fabric.

3. The posable figure of claim 2, wherein the fabric comprises a plush fabric.

4. The posable figure of claim 1, further comprising:

a first opposing magnet disposed under the fabric within the figure's head in proximity to a first eye defined by the figure;

a second magnet disposed under the fabric within a second limb; and a second opposing magnet disposed under the fabric within the figure's head in proximity to a second eye defined by the figure, the first and second magnets being joinable with the first and second opposing magnets, respectively, to selectively pose the first and second limbs to cover the figure's eyes.

5. The posable figure of claim 1, further comprising:

a first opposing magnet disposed under the fabric within the figure's torso;

a second magnet disposed under the fabric within a second limb; and a second opposing magnet disposed under the fabric within the figure's torso in proximity to the first opposing magnet, the first and second magnets being joinable with the first and second opposing magnets, respectively, to cover the figure's torso with the figure's limbs.

6. A posable figure having a head, torso, and a plurality of limbs, comprising:

a formative support defining the figure's head, torso and limbs;

a first magnet disposed within a first limb; and an opposing magnet disposed within at least one of the figure's head and torso to enable posing of the first limb by joining the first magnet with the opposing magnet.

* * * * *